US009097115B2

(12) United States Patent
Naryzhny et al.

(10) Patent No.: US 9,097,115 B2
(45) Date of Patent: Aug. 4, 2015

(54) TURBINE VANE

(75) Inventors: Oleg Dmitrievich Naryzhny, Moscow (RU); Andrey Petrovich Morozov, Khimki (RU); Alexander Anatolievich Khanin, Moscow (RU)

(73) Assignee: ALSTOM TECHNOLOGY LTD, Baden (CH)

( * ) Notice: Subject to any disclaimer, the term of this patent is extended or adjusted under 35 U.S.C. 154(b) by 457 days.

(21) Appl. No.: 13/535,380

(22) Filed: Jun. 28, 2012

(65) Prior Publication Data

US 2013/0004295 A1 Jan. 3, 2013

(30) Foreign Application Priority Data

Jul. 1, 2011 (RU) ..... 2011127161

(51) Int. Cl.
*F01D 9/04* (2006.01)
*F01D 9/02* (2006.01)

(52) U.S. Cl.
CPC ... *F01D 9/02* (2013.01); *F01D 9/04* (2013.01)

(58) Field of Classification Search
CPC ..... F01D 9/02; F01D 9/04
USPC ..... 415/115, 139, 230; 277/644, 647
See application file for complete search history.

(56) References Cited

U.S. PATENT DOCUMENTS 3,529,906 A 9/1970 McLaurin et al.
3,752,598 A * 8/1973 Bowers et al. ..... 415/115
4,017,213 A * 4/1977 Przirembel ..... 416/97 A
4,063,845 A 12/1977 Allen
4,126,405 A 11/1978 Bobo et al.
4,524,980 A 6/1985 Lillibridge et al.
4,688,988 A * 8/1987 Olsen ..... 415/116

(Continued)

FOREIGN PATENT DOCUMENTS

CN 1219215 A 6/1999
CN 1906381 A 1/2007

(Continued)

OTHER PUBLICATIONS

Office Action issued on Sep. 4, 2014, by the State Intellectual Property Office of People's Republic China in corresponding Chinese Patent Application No. 201210224173.2, and an English Translation of the Office Action. (13 pages).

(Continued)

*Primary Examiner* — Liam McDowell
(74) *Attorney, Agent, or Firm* — Buchanan Ingersoll & Rooney PC

(57) ABSTRACT

A stator for a turbine includes an arrangement of vanes including at least a first vane and a second vane circumferentially neighboring the first vane. Each of the first vane and the second vane include: an airfoil; a channel system configured to cool the respective vane with cooling gas; and an inner diameter platform disposed at an inner end of the airfoil, the inner diameter platform including an inner diameter platform cavity and a circumferentially arranged side wall which delimits the inner diameter platform cavity, the inner diameter platform cavity being connected with the channel system so as to feed the cooling gas to the inner diameter platform. At least one sealing plate is disposed between the circumferentially arranged side walls of the first vane and the second vane so as to form an intermediate cavity that is fluidically separated from the inner diameter platform cavities.

20 Claims, 2 Drawing Sheets

(56) References Cited

U.S. PATENT DOCUMENTS

| | | | | |
|---|---|---|---|---|
| 5,127,793 | A | 7/1992 | Walker et al. | |
| 5,531,457 | A | 7/1996 | Tibbott et al. | |
| 5,545,002 | A | 8/1996 | Bourguignon et al. | |
| 5,738,490 | A | 4/1998 | Pizzi | |
| 5,762,472 | A | 6/1998 | Pizzi et al. | |
| 5,868,398 | A | 2/1999 | Maier et al. | |
| 5,988,975 | A | 11/1999 | Pizzi | |
| 5,997,247 | A * | 12/1999 | Arraitz et al. | 415/139 |
| 6,331,096 | B1 | 12/2001 | Burdgick et al. | |
| 6,427,327 | B1 | 8/2002 | Bunker | |
| 7,037,071 | B2 | 5/2006 | Antunes et al. | |
| 7,112,042 | B2 | 9/2006 | Tatsumi et al. | |
| 7,559,740 | B2 | 7/2009 | Bigi et al. | |
| 7,625,172 | B2 | 12/2009 | Walz et al. | |
| 7,762,761 | B2 | 7/2010 | Busch et al. | |
| 8,430,626 | B1 * | 4/2013 | Liang | 415/139 |
| 8,747,066 | B2 * | 6/2014 | Strom et al. | 415/214.1 |
| 8,790,073 | B2 | 7/2014 | Mugglestone | |
| 8,845,285 | B2 | 9/2014 | Weber et al. | |
| 2003/0180141 | A1 * | 9/2003 | Kress et al. | 415/115 |
| 2005/0135920 | A1 | 6/2005 | Synnott et al. | |
| 2007/0122275 | A1 | 5/2007 | Busch et al. | |
| 2007/0147994 | A1 | 6/2007 | Bigi et al. | |
| 2007/0253816 | A1 | 11/2007 | Walz et al. | |
| 2009/0223202 | A1 | 9/2009 | Nanataki et al. | |
| 2012/0039708 | A1 | 2/2012 | Mugglestone | |
| 2013/0177412 | A1 | 7/2013 | Weber et al. | |

FOREIGN PATENT DOCUMENTS

| | | | |
|---|---|---|---|
| CN | 101063411 | A | 10/2007 |
| EP | 1 143 109 | A2 | 10/2001 |
| EP | 1 221 536 | A2 | 7/2002 |
| EP | 1 411 209 | A2 | 4/2004 |
| EP | 1 793 088 | A2 | 6/2007 |
| EP | 2 211 024 | A1 | 7/2007 |
| EP | 2 105 581 | A2 | 9/2009 |
| EP | 2 615 254 | A2 | 7/2013 |
| GB | 2 058 944 | A | 4/1981 |
| JP | 46-20607 | A | 6/1971 |
| JP | 60-138204 | A | 7/1985 |
| JP | 10-184310 | A | 7/1998 |
| JP | 11-22413 | A | 1/1999 |
| JP | 11-117707 | A | 4/1999 |
| JP | 2001-20705 | A | 1/2001 |
| JP | 2002-201962 | A | 7/2002 |
| JP | 2003-035105 | A | 2/2003 |
| JP | 2003-83001 | A | 3/2003 |
| JP | 2005-337215 | A | 12/2005 |
| JP | 2007-514888 | A | 6/2007 |
| JP | 2008-223515 | A | 9/2008 |
| RU | 2159856 | C2 | 11/2000 |
| RU | 2171380 | C2 | 7/2001 |
| RU | 2296865 | C2 | 4/2007 |

OTHER PUBLICATIONS

Office Action (Patent Examination Report No. 1) issued on Sep. 8, 2014, by the Australian Patent Office in corresponding Australian Patent Application No. 2012203822. (5 pages).

Notification of Reason for Refusal issued Jan. 5, 2015 by the Japanese Patent Office in corresponding Japanese Application No. 2012-14832, and a translation thereof.

Search Report issued on Mar. 2, 2012 by the European Patent Office in corresponding Swiss Application No. 14182011.

Office Action issued Aug. 28, 2014 by the Russian Patent Office in corresponding Russian Application No. 2011127161/06.

* cited by examiner

TURBINE VANE

CROSS-REFERENCE TO PRIOR APPLICATION

Priority is claimed to Russian Patent Application No. RU 2011127161, filed on Jul. 1, 2011, the entire disclosure of which is hereby incorporated by reference herein.

FIELD

The present invention relates to a stator for a turbine, in particular for a gas turbine. The invention further relates to a turbine comprising such a stator as well as a vane of such a stator.

BACKGROUND

A stator is an essential component of a turbine, wherein the stator comprises vanes guiding a driving fluid of the turbine onto blades of a rotor of the turbine thereby leading to a rotation of the blades and thus the rotor. The rotation axis of the rotor defines an axial direction. A radial direction and a circumferential direction are each defined in relation to the axial direction. The vanes of the stator are arranged in rows, wherein each row usually comprises circumferentially neighbouring vanes. Said vanes usually comprise an airfoil being arranged on an inner diameter platform of the vane and at the inner end of the airfoil, wherein the term inner is defined with respect to the radial direction.

In the case of a gas turbine the driving fluid is an expanding gas, wherein the expansion is achieved by the combustion of said gas. Therefore the vanes of the stator are exposed to high temperatures, which results in a high thermodynamic stress of the vanes. In order to reduce said stress vanes usually comprise a channel system for cooling the vane with cooling gas thereby using said cooling gas to also cool the inner diameter platform, that is, the channel system is connected to a cavity of the inner diameter platform, wherein said inner diameter platform cavity is, in particular, delimited by side walls of the corresponding inner diameter platform. The term, 'side wall', is thereby defined with respect to the circumferential direction, wherein the side walls of the inner diameter platform each face a side wall of the inner diameter platform of a circumferentially neighbouring vane. Considering the arrangement of the vanes of the stator, this leads to a gap between the facing side walls.

SUMMARY

In an embodiment, the present invention provides a stator for a turbine having an arrangement of vanes including at least a first vane and a second vane circumferentially neighbouring the first vane. Each of the first vane and the second vane include: an airfoil; a channel system configured to cool the respective vane with cooling gas; and an inner diameter platform disposed at an inner end of the airfoil, the inner diameter platform including an inner diameter platform cavity and at least one circumferentially arranged side wall which delimits the inner diameter platform cavity, the inner diameter platform cavity being connected with the channel system so as to feed the cooling gas to the inner diameter platform. At least one sealing plate is disposed between the at least one circumferentially arranged side wall of the first vane and the at least one circumferentially arranged side wall of the second vane, the at least one circumferentially arranged side walls of the first vane and the second vane facing one another, so as to form an intermediate cavity that is fluidically separated from the inner diameter platform cavities.

BRIEF DESCRIPTION OF THE DRAWINGS

The present invention will be described in even greater detail below based on the exemplary figures, which are schematic. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
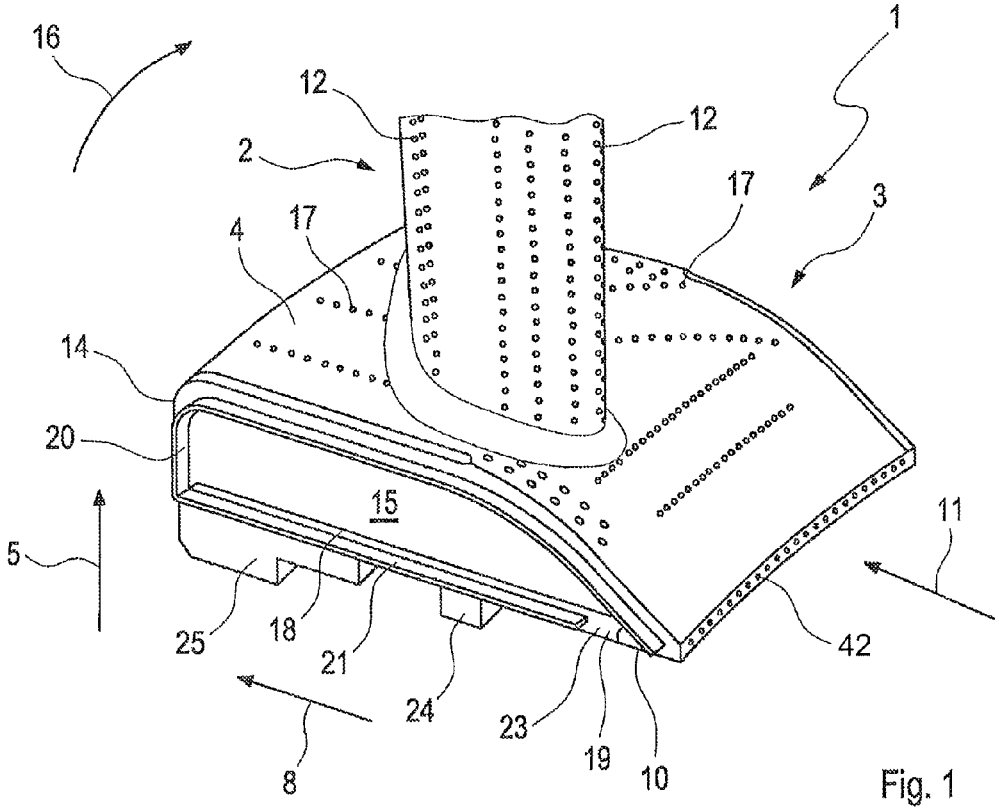
FIG. 1 shows a perspective view of a vane inner platform.

In an embodiment, the present invention solves the problem of delivering an improved or at least alternative embodiment for a stator of the above kind, which has improved sealing.

In an embodiment, the present invention forms an intermediate cavity between side walls of inner diameter platforms of circumferentially neighbouring vanes of a stator by making use of a gap between said side walls, wherein the inner diameter platform of a vane is arranged at the inner end of an airfoil of the corresponding vane and the side wall of the inner diameter platform is facing the side wall of the inner diameter platform of a circumferentially neighbouring vane with the side walls delimiting an inner diameter platform cavity of the corresponding inner diameter platform. The vanes moreover each comprise a channel system for cooling the respective vane with cooling gas, wherein the inner diameter platform cavity is connected to the channel system and thus cooled with said cooling gas and the intermediate cavity is fluidically separated from the respective inner diameter platform cavities, in particular by means of the side walls. The intermediate cavity between the circumferentially neighbouring inner diameter platforms thereby in particular interrupts or at least reduces a leakage of a driving fluid of the turbine into the gap between the side walls. The circumferential direction being in relation to a rotational axis of a rotor of a corresponding turbine the stator is assembled in. A radial direction can be respectively defined in relation to the rotational axis.

According to the invention, an embodiment comprises a gap between the facing side walls of two circumferentially neighbouring vanes. This gap is now enclosed by at least one sealing plate to form the intermediate cavity. Said intermediate cavity is thus delimited by the side wall in the circumferential direction and enclosed by the sealing plate/plates. The intermediate cavity is therefore separated and thus fluidically isolated form the inner diameter platform cavity of the corresponding inner diameter platforms. This arrangement of the sealing plates in particular leads to an improved sealing of the intermediate cavity.

According to a preferred embodiment at least one of the inner diameter platforms comprising the side wall forming the intermediate cavity, comprises at least one groove in the region of the intermediate cavity. The groove is thereby constructed around the intermediate cavity, i.e. the groove encloses the intermediate cavity. In the case where several grooves are provided, these grooves are preferably arranged around the intermediate cavity and in particular distributed in a homogeneous or continuous manner. The grooves are thus constructed as groove sections running around the intermediate cavity. Said groove/grooves are further adapted for receiving at least one sealing plate enclosing the intermediate cavity. The sealing plate is hence arranged within said groove, wherein the groove and thus the sealing plate extend around the intermediate cavity. Therefore the groove/grooves can be constructed within the side walls of the respective inner diameter platforms. In a preferred embodiment two platforms each comprise one side wall forming the intermediate cavity, wherein said side walls each comprise grooves for receiving at least one sealing plate. The grooves of said inner diameter platforms thereby comprise a complementary arrangement and/or shape. That is, in particular, the grooves of the respective inner diameter platforms can be shaped and constructed similarly and arranged directly opposite each other. They can also be constructed differently and an enclosed sealing can be ensured by the arrangement of the sealing plates. In the case where several grooves are provided in each inner diameter platform, i.e. where there are groove sections, the sections in neighbouring platforms can be arranged to face each other, that is, the groove sections of the inner diameter platforms are in particular arranged in the same manner. The groove sections can also be displaced with respect to each other, that is, they may be arranged in different ways. In the latter case a preferred embodiment is one, which provides at least one groove section around any part of an intermediate cavity region. It shall be mentioned that it is also possible to arrange the sealing plates such that they overlap. This overlap can be realised both by means of facing sealing plates and/or be means of neighbouring sealing plates arranged within the groove/grooves of one of the inner diameter platforms.

It is understood, that the sealing plates comprise a complementary shape and arrangement to the respective grooves. That is, the sealing plates are in particular constructed to fit and fill the corresponding groove/grooves. The respective conditions within the turbine thereby require respective properties of the sealing plates, for instance, heat resistance. Therefore metals and alloys are preferred materials of the sealing plates.

According to a further preferred embodiment the sealing plate/plates form a peripheral seal of the intermediate cavity. That is in particular, the sealing plate/plates encircle the intermediate cavity thereby completely or at least substantially sealing the intermediate cavity along the respective direction. A complete or at least substantial sealing of the intermediate cavity is thus given by the side walls and the sealing plate/plates, wherein the sealing plate/plates contact the corresponding inner diameter platforms, in particular in the region of the groove/grooves.

According to a particularly preferred embodiment the two facing side walls each comprise a groove, wherein said grooves are similarly shaped and arranged within the respective side walls in a symmetric manner. In this embodiment two sealing plates are arranged within these grooves. One of the sealing plates is arranged at the bottom side of the respective inner diameter platform with the bottom side opposing the airfoil. Said sealing plates contact each other at the ends of the respective sealing plates. The latter sealing plate is arranged within the remaining groove area, i.e. in particular, said sealing plate runs from a back side of the intermediated cavity to its top side adjacent to the airfoil and continues to a front side of the intermediate cavity to contact the first sealing plate by means of the ends of the respective sealing plates. The front side and the back side are thereby defined with respect to a flow direction of the driving fluid of the turbine. In that sense, the front side is the upstream side and the back side is the downstream side.

The peripheral sealing of the intermediate cavity comprises at least one opening according to a further embodiment. Said opening can thereby be realised by means of a cut-out within the respective sealing plate/plates and/or an interruption within the respective sealing plate/plates. The opening is thereby preferably arranged on the bottom side of the intermediate cavity, i.e. the opening is constructed within the side of the sealing opposing the airfoil. Said opening is moreover preferably arranged on the front side of the intermediate cavity, i.e. on the upstream side of the intermediate cavity. The opening now serves in particular as an inlet for a pressurized gas. That is, the intermediate cavity is pressurized by means of the pressurized gas pumped into the intermediate cavity via said opening. The pressurisation of the intermediate cavity in particular aims to improve the sealing of the intermediate cavity by preventing the driving fluid of the turbine from entering the intermediate cavity.

According to a preferred embodiment, said opening is fluidically separated from the channel system of the respective vane. In other words, the opening of the intermediate cavity is fluidically isolated form the channel system used for cooling the vane and in particular the inner diameter platform by means of the inner diameter platform cavity. That is, the opening of the intermediate cavity is fluidically disconnected from the inner diameter platform cavity preserving the separation between both said cavities. Thus the charge gas and the cooling gas can run through different gas supply devices of the turbine and can moreover be different.

In a further embodiment, the vane comprises an outer diameter platform, wherein the outer diameter platform is arranged at the outer end of the airfoil of the vane with the outer end referring to the radial direction. That is the outer diameter platform is arranged at the end of the airfoil opposing the end connected to the inner diameter platform. The outer diameter platform further comprises an outer diameter platform cavity, which is connected to the channel system. The outer diameter platform moreover preferably comprises a cooling gas inlet to introduce the cooling gas into the outer diameter platform cavity. Hence, said cooling gas is used to cool the outer diameter platform and the inner diameter platform. Therefore the channel system runs through the airfoil, in particular by means of at least one channel, wherein said channel preferably runs from the outer diameter platform to the inner diameter platform and/or vice versa. Thus said cooling gas also cools the airfoil. Therefore the construction is simplified in order to provide pressurised gas for pressurising the intermediate cavity on the one hand an to provide cooling gas for cooling the outer diameter platform, the airfoil and the inner diameter platform on the other hand.

It shall be mentioned, that the opening of the intermediate cavity can have an arbitrary size and shape. However, a symmetric shape, such as a circular shape is favoured, wherein said circular opening is preferably arranged on the front side of the intermediate cavity and thus on the upstream side of the vane and opposes the airfoil, i.e. the opening is arranged within the bottom side of the intermediate cavity. The size of the opening thereby does not exceed the width of the intermediate cavity in the respective region in order to maintain the fluidic separation between the intermediate cavity and the neighbouring inner diameter platform cavities.

According to a further embodiment the groove of the inner diameter platform comprises at least one interruption, wherein the interruption is arranged at the opening of the intermediate cavity. Said interruption is thus aligned with or aligned facing said opening and preferably arranged on the bottom side of the corresponding inner diameter platform. In the case of several grooves, these grooves are preferably arranged in a symmetrical manner to be facing and/or enclosing said opening. In the case of grooves within both inner diameter platforms forming the intermediate cavity, said grooves also comprise symmetrically arranged interruptions aligned with or facing the opening.

In order to ensure a reasonable sealing between the vane and a vane carrier, the vane comprises a sealing at the bottom plate of the inner diameter platform. Said sealing is thus arranged on the side of the inner diameter platform opposing the airfoil and projects radially inwards. An example for such a sealing is a ring shaped seal, in particular a Del Matto seal, as disclosed for example in U.S. Pat. No. 4,050,702, the disclosure to which is herewith incorporated to the present disclosure by reference.

According to a further embodiment the inner diameter platform comprises at least one gas outlet, wherein said gas outlet is in particular arranged within the top plate of the inner diameter platform. The gas outlets are thus in particular arranged on the side of the inner diameter platform facing the airfoil. Said gas outlets thereby penetrate through the respective wall of the inner diameter platform to provide outlets for the cooling gas from the inner diameter platform cavity. The gas outlets are therefore preferably arranged on the downstream side of the inner diameter platform and can thus also be arranged within/at the front side of the inner diameter platform.

As the vanes and the inner diameter platforms are an important part of an embodiment of the invention, it is understood, that a single vane used in a stator according to an embodiment of the invention also falls under the scope of the invention.

It is understood, that the idea of the intermediate cavity can also be realised between a vane comprising an inner diameter platform and an inner diameter platform cavity and a vane without an inner diameter platform cavity as well as between a vane comprising an inner diameter platform and an inner diameter platform cavity and a vane without an inner diameter platform. Combinations thereof are also adapted for the implementation of the intermediate cavity. These variations thus also belong to the scope of the invention.

According to a further aspect of the invention a turbine, in particular a gas turbine comprises a stator according to an embodiment of the invention. Said turbine is in particular characterised by an improved efficiency in particular by means of the improved sealing of the stator.

It is understood that the aforementioned features and the features to be mentioned hereafter are applicable not only in the given combination, but also in other combinations as well as separated without departing from the scope of the invention.

The above and other features and advantages of the invention will become more apparent from the following description of certain preferred embodiments thereof, when taken in conjunction with the accompanying drawings.

Figure 3:
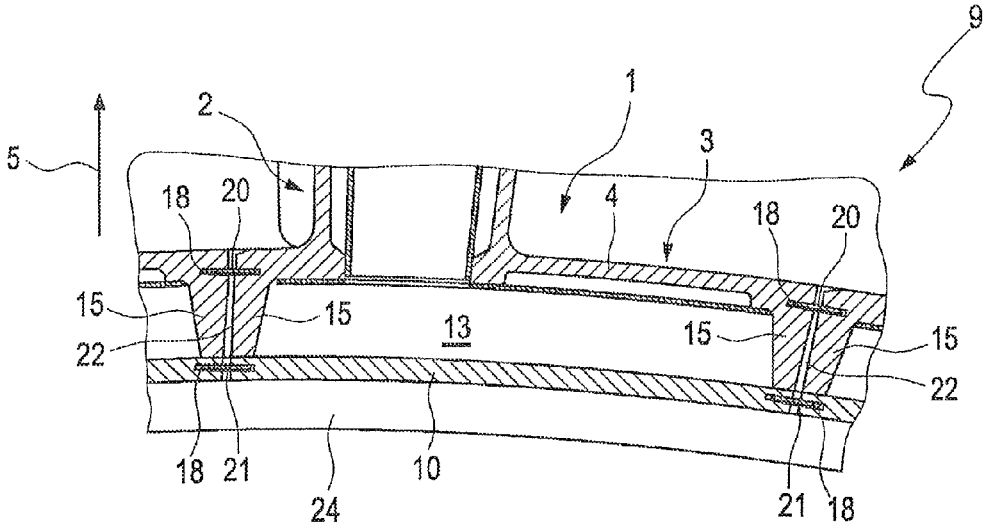
FIG. 3 shows a cross section of a vane inner platform.
Figure 2:
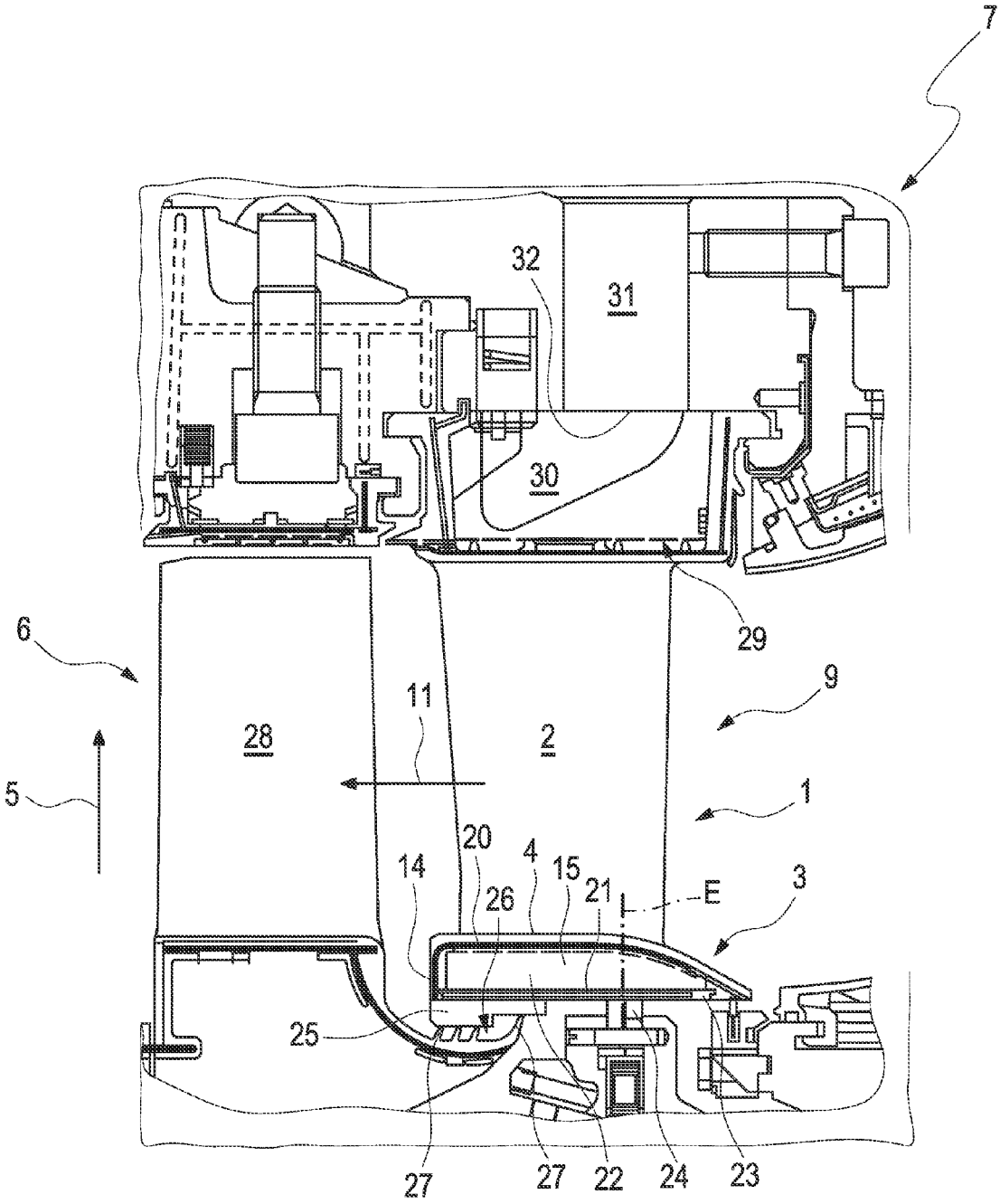
FIG. 2 shows a longitudinal section view of a turbine.

Referring to FIG. 1 to FIG. 3 a vane 1 comprises an airfoil 2 and a platform 3, wherein the platform 3 carries the airfoil 2 on its top plate 4 and at the inner end of the airfoil 2. The term, 'top', thereby is in relation to a radial direction depicted by the arrow 5 which in turn is in relation to an axial direction of the rotation of a rotor 6 of a turbine 7 illustrated by the arrow 8, wherein the turbine 7 comprises a stator 9 comprising the shown vane 1.

As shown in FIG. 1 the top plate 4 has a flat portion and then bends towards a bottom plate 10 of the inner diameter platform 3 and contacts the bottom plate 10 with an acute angle at an upstream side of the inner diameter platform 3, wherein the upstream side or the front side is defined with respect to a flow direction of a driving fluid flowing through the turbine 7 and depicted by the arrow 11. The airfoil 2 comprises holes 12 arranged in radially running rows along the airfoil 2. These holes serve as outlets for a cooling gas flowing through the airfoil 2 by means of channels of a channel system. The channel system is connected to an inner diameter platform cavity 13 of the inner diameter platform 3, wherein said inner diameter platform cavity 13 is formed by the top plate 4, the bottom plate 10, a back wall 14 and side walls 15 of the inner diameter platform 3. The back wall 14 is thereby the wall on the downstream side of the inner diameter platform 3. The side walls 15 extend in the axial and radial directions and delimit the inner diameter platform cavity 13 in a circumferential direction given by the arrow 16 and defined in relation to the rotational axis of the turbine 7 given by the arrow 8. The top plate 4 of the inner diameter platform 3 comprises gas outlets 17 distributed along rows over the top plate 4 and connected to the inner diameter platform cavity 13. There are further holes 42 within the front area of the inner diameter platform 3 connected to the inner diameter platform cavity 13 and also serving as outlets for the cooling gas. The further holes 42 within the front area of the inner diameter platform 3 face in the axial or flow direction.

The side wall 15 of the vane 1 comprises a groove 18. Said groove 18 starts at the front side of the inner diameter platform 3 and runs along and, in particular, follows the contour of the top plate 4. The groove 18 continues to run along the back wall 14 and follows the contour of the curved transition between the top plate 4 and the back wall 14 of the inner diameter platform 3. The groove 18 continues along the bottom plate 10 of the inner diameter platform 3 with a right-angled transition and stops at position spaced from the front side of the inner diameter platform 3. That is, the groove 18 comprises an interruption 19 within the bottom plate 10 region and on the front side, and thus the upstream side, of the inner diameter platform 3. A first sealing plate 20 is arranged within the groove 18 running in the region along the top plate 4 and the back wall 14. Said sealing plate 20 thus comprises a shape which is complementary to this region of the groove 18. The sealing plate 20 is therefore shaped with a curved transition in the transition region between the top plate 4 and the back wall 14. A second sealing plate 21 is arranged within the region of the groove 18 running along the bottom plate 10, wherein said sealing plate 21 contacts the first sealing plate 20 in the right angled transition region of the groove 18 and thus on the downstream side of the inner diameter platform 3. The second sealing plate 21 comprises a flat shape and fills the whole remaining groove 18 region, i.e. in particular it extends to the edge of the interruption 19. Both sealing plates 20, 21 thereby project away from the side wall 18 and thus towards the side wall 18 of the inner diameter platform 3 of a circumferentially neighbouring vane 1. These plates 20, 21 are therefore adapted to be arranged within the grooves of the facing side walls 15 of adjacent inner diameter platforms 3. The groove 18 of the facing inner diameter platform 3 has a complementary form, i.e. in particular a complementary interruption, to the opposing groove 18, leading to the formation of an intermediate cavity 22 between the facing side walls 15. Said intermediate cavity 22 is thereby delimited by the facing side walls 15 of the circumferentially neighbouring vanes 1 and by the sealing plates 20, 21, as shown in FIG. 3. The sealing plates 20, 21 thus form a peripheral sealing of the intermediate cavity 22. The respective interruptions 19 of the corresponding grooves 18 further provide an opening 23 within the peripheral sealing with the said opening being arranged on the bottom side of the cavity, i.e. the side opposing the airfoil 3, and on the upstream side of the vanes 1. The alignment and symmetric arrangement of the interruptions 19 thereby leads to a symmetric and, in particular, a rectangular or circular shape of the opening 23.

The shown vane 1 further comprises a Del Matto sealing 24 connected to the bottom plate 10 of the inner diameter platform 3 within the centre region of the bottom plate and projecting radially inwards, i.e. in the opposite direction to the arrow 5. The vane further comprises a sealing part 25 also connected to the bottom plate 10 and projecting radially inwards, but arranged on the downstream side of the inner diameter platform 3. Said sealing part 25 comprises a stepped shape and is adapted to form a labyrinth sealing 26 with fins 27 of a downstream neighbouring blade 28 of the rotor 6 of the turbine 7, as shown in FIG. 2. FIG. 2 also shows an outer diameter platform 29 of the vane 1 arranged at the outer end of the airfoil 2 with respect to the radial direction given by the arrow 5. Thus, the inner diameter platform 3 is arranged at the inner end of the airfoil 2 while the outer diameter platform 29 is arranged at the outer end of the airfoil 2. The outer diameter platform 29 moreover comprises an outer diameter platform cavity 30 connected to a cooling gas supply device 31 by means of a gas inlet 32 of the outer diameter platform 29.

FIG. 3 shows a cross section through the stator 9 of the turbine 7, with the cross section taken through the line E in FIG. 2. An inner diameter platform cavity 13 of a vane 1 is seen in the lower centre region. The side walls 15 of said inner diameter platform cavity 13 are facing the side walls 15 of circumferentially neighbouring inner diameter platform cavities 13. Intermediate cavities 22 are arranged on both sides of the centre inner diameter platform cavity 13, wherein said intermediate cavities 22 are delimited by side walls 15 of the respective adjacent inner diameter platforms 3 and by sealing plates 20, 21 arranged within symmetrically constructed grooves 18 of the respective adjacent inner diameter platforms 3.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

LIST OF REFERENCE NUMERALS

1 Vane
2 Airfoil
3 Inner diameter platform
4 Top plate
5 Arrow depicting the radial direction
6 Rotor
7 Turbine
8 Arrow depicting the axial direction
9 Stator
10 Bottom plate
11 Arrow depicting the driving fluid direction
12 Hole
13 Inner diameter platform cavity
14 Back wall
15 Side wall
16 Arrow depicting the circumferential direction
17 Gas outlet
18 Groove
19 Interruption
20 Sealing plate
21 Sealing plate
22 Intermediate cavity
23 Opening
24 Del Matto sealing
25 Sealing part
26 Labyrinth sealing
27 Fin
28 Blade
29 Outer diameter platform
30 Outer diameter cavity
31 Cooling gas supply device
32 Gas inlet

What is claimed is:

1. A stator for a turbine comprising:

an arrangement of vanes including at least a first vane and a second vane circumferentially neighbouring the first vane, each of the first vane and the second vane comprising:

an airfoil;

a channel system configured to cool each respective vane with cooling gas; and an inner diameter platform disposed at an inner end of the airfoil, the inner diameter platform including an inner diameter platform cavity and at least one circumferentially arranged side wall which delimits the inner diameter platform cavity, the inner diameter platform cavity being connected with the channel system so as to feed the cooling gas to the inner diameter platform;

at least one sealing plate disposed between the at least one circumferentially arranged side wall of the first vane and the at least one circumferentially arranged side wall of the second vane, the at least one circumferentially arranged side walls of the first vane and the second vane facing one another, so as to form an intermediate cavity that is fluidically separated from the inner diameter platform cavity;

wherein the at least one sealing plate forms a peripheral sealing that at least substantially encloses the intermediate cavity;

wherein the peripheral sealing includes at least one opening that is disposed at a bottom side of the intermediate cavity, which is a radially furthest away side from the airfoil, and that is configured as a gas inlet; and wherein the at least one opening has a circular shape.

2. The stator according to claim 1, wherein the turbine is a gas turbine.

3. The stator according to claim 1, wherein the inner diameter platform of at least one of the first vane and the second vane includes at least one groove disposed around a region of the intermediate cavity, the at least one sealing plate being disposed in the at least one groove.

4. The stator according to claim 1, wherein the at least one opening is fluidically separated from the channel systems of the first vane and the second vane.

5. The stator according to claim 1, comprising:

a ring shaped sealing disposed on an underside of a bottom plate of the inner diameter platform, the bottom plate being disposed on a side of the inner diameter platform cavity that is furthest away from the airfoil.

6. The stator according to claim 5, wherein the ring shaped sealing is a Del Matto sealing.

7. The stator according to claim 1, wherein, for each of the first vane and the second vane, the channel system includes at least one channel extending within the airfoil and connected to an outer diameter platform cavity disposed at a radially outer end of the airfoil of a respective one of the vanes.

8. The stator according to claim 1, wherein, for each of the first vane and the second vane, the inner diameter platform includes at least one gas outlet.

9. The stator according to claim 8, wherein the at least one gas outlet is disposed on a side of the inner diameter platform facing the airfoil.

10. The stator according to claim 1, comprising:

a ring shaped sealing disposed on an underside of a bottom plate of the inner diameter platform, the bottom plate being disposed on a side of the inner diameter platform cavity that is furthest away from the airfoil.

11. The stator according to claim 10, wherein the ring shaped sealing is a Del Matto sealing.

12. A stator for a turbine comprising:

an arrangement of vanes including at least a first vane and a second vane circumferentially neighbouring the first vane, each of the first vane and the second vane comprising:

an airfoil:

a channel system configured to cool each respective vane with cooling gas; and an inner diameter platform disposed at an inner end of the airfoil, the inner diameter platform including an inner diameter platform cavity and at least one circumferentially arranged side wall which delimits the inner diameter platform cavity, the inner diameter platform cavity being connected with the channel system so as to feed the cooling gas to the inner diameter platform;

at least one sealing plate disposed between the at least one circumferentially arranged side wall of the first vane and the at least one circumferentially arranged side wall of the second vane, the at least one circumferentially arranged side walls of the first vane and the second vane facing one another, so as to form an intermediate cavity that is fluidically separated from the inner diameter platform cavity;

wherein the at least one sealing plate forms a peripheral sealing that at least substantially encloses the intermediate cavity;

wherein the peripheral sealing includes at least one opening that is disposed at a bottom side of the intermediate cavity, which is a radially furthest away side from the airfoil, and that is configured as a gas inlet; and wherein the inner diameter platform of at least one of the first vane and the second vane includes at least one groove disposed around a region of the intermediate cavity, the at least one groove including an interruption that is aligned with or forms part of a boundary of the at least one opening.

13. The stator according to claim 12, wherein the turbine is a gas turbine.

14. The stator according to claim 12, wherein the inner diameter platform of at least one of the first vane and the second vane includes at least one groove disposed around a region of the intermediate cavity, the at least one sealing plate being disposed in the at least one groove.

15. The stator according to claim 12, wherein the at least one opening is fluidically separated from the channel systems of the first vane and the second vane.

16. The stator according to claim 12, wherein the at least one opening has a symmetrical shape.

17. The stator according to claim 12, wherein, for each of the first vane and the second vane, the channel system includes at least one channel extending within the airfoil and connected to an outer diameter platform cavity disposed at a radially outer end of the airfoil of a respective one of the vanes.

18. The stator according to claim 12, wherein, for each of the first vane and the second vane, the inner diameter platform includes at least one gas outlet, and wherein the at least one gas outlet is disposed on a side of the inner diameter platform facing the airfoil.

19. A turbine comprising:

a rotor; and at least one stator comprising:

an arrangement of vanes including at least a first vane and a second vane circumferentially neighbouring the first vane, each of the first vane and the second vane comprising: an airfoil;

a channel system configured to cool each respective vane with cooling gas; and an inner diameter platform disposed at an inner end of the airfoil, the inner diameter platform including an inner diameter platform cavity and at least one circumferentially arranged side wall which delimits the inner diameter platform cavity, the inner diameter platform cavity being connected with the channel system so as to feed the cooling gas to the inner diameter platform, and at least one sealing plate disposed between the at least one circumferentially arranged side wall of the first vane and the at least one circumferentially arranged side wall of the second vane, the at least one circumferentially arranged side walls of the first vane and the second vane facing one another, so as to form an intermediate cavity that is fluidically separated from the inner diameter platform cavity;

wherein the at least one sealing plate forms a peripheral sealing that at least substantially encloses the intermediate cavity;

wherein the peripheral sealing includes at least one opening that is disposed at a bottom side of the intermediate cavity, which is a radially furthest away side from the airfoil, and that is configured as a gas inlet; and wherein the inner diameter platform of at least one of the first vane and the second vane includes at least one groove disposed around a region of the intermediate cavity, the at least one groove including an interruption that is aligned with or forms part of a boundary of the at least one opening.

20. The turbine according to claim 19, wherein the turbine is a gas turbine.

* * * * *